US009534792B2

(12) United States Patent
Fogolin

(10) Patent No.: US 9,534,792 B2
(45) Date of Patent: Jan. 3, 2017

(54) BURNER FOR A GAS COOKTOP

(71) Applicant: Electrolux Professional S.p.A., Pordenone (IT)

(72) Inventor: Stefano Fogolin, S. Vito al Tagliamento (IT)

(73) Assignee: ELECTROLUX PROFESSIONAL S.P.A., Pordenone (IT)

( * ) Notice: Subject to any disclaimer, the term of this patent is extended or adjusted under 35 U.S.C. 154(b) by 658 days.

(21) Appl. No.: 14/025,170

(22) Filed: Sep. 12, 2013

(65) Prior Publication Data

US 2014/0076303 A1 Mar. 20, 2014

(30) Foreign Application Priority Data

Sep. 17, 2012 (EP) ..... 12184702

(51) Int. Cl.
*F24C 3/08* (2006.01)
*F23D 14/06* (2006.01)

(52) U.S. Cl.
CPC ..... *F24C 3/085* (2013.01); *F23D 14/06* (2013.01); *F23D 2900/14062* (2013.01)

(58) Field of Classification Search
CPC .. F24C 3/085; F23D 14/06; F23D 2900/14062
See application file for complete search history.

(56) References Cited

FOREIGN PATENT DOCUMENTS

| | | |
|---|---|---|
| EP | 0552135 | 7/1993 |
| FR | 2841326 | 12/2003 |
| FR | 2915267 | 10/2008 |

OTHER PUBLICATIONS

European Search Report for EP 12184702.4, dated Jan. 17, 2013.

*Primary Examiner* — Alfred Basichas
(74) *Attorney, Agent, or Firm* — Pearne & Gordon LLP

(57) ABSTRACT

A burner for a gas cooktop comprising a main body provided with a first plurality of holes capable of producing first flames at a first angle with respect to a horizontal reference plane, and a second plurality of holes capable of producing second flames at a second angle with respect to said horizontal plane, which is smaller than the first, said first and second pluralities of holes consisting of corresponding groups of holes, each group being associated with the same flame and each group consisting of at least one hole, characterized in that the total cross-sectional area of each group of holes of the second plurality of holes is greater than the total cross-sectional area of each group of holes of the first plurality of holes, such that the second flames are more powerful than the first flames.

17 Claims, 4 Drawing Sheets

BURNER FOR A GAS COOKTOP

The present invention refers to a burner for a gas cooktop.

Various types of burners of various sizes are known for household and professional applications.

A common feature of practically all burners is that they have a main burner body provided with holes for the flames to exit.

An example of a burner made by the applicant is described in French patent application FR2841326.

That patent application describes a burner with a main burner body having a substantially cylindrical side wall provided with a plurality of holes for the flames to exit. In order to provide a better oxygen supply to the flames, the burner has holes at different angles which alternate along the circumference of the burner. Therefore, starting with a certain position on the side wall of the main body and moving in the clockwise or counterclockwise direction, the first hole will have an angle h with respect to the horizontal plane, the second hole will have an angle k which is different from h, the third hole once again h, the fourth hole once again k, and so on until the circumference is completed, as shown in FIGS. 6 and 7 of that patent application.

Thanks to the better oxygen supply to the flames, this solution also makes it possible to enlarge the size of the holes or to increase the number thereof in order to increase the corresponding power of the flames. In the solution having a larger number of holes, in place of each hole there are two holes of the same diameter and angle, one placed on top of the other, capable of forming a single flame at that angle, as shown in FIGS. 8 and 9 of the aforementioned patent application. In this way, a pair of holes at angle h will be followed by a pair of holes at angle k, and then another pair of holes at angle h, and so on.

However, the applicant has found that this solution is not entirely satisfactory because the flames at a lower angle, that is, the "more horizontal" flames, are also further from the pot (or other object being heated) placed on the burner, such that their ability to heat the pot is weaker compared to that of the other flames.

This problem is solved by the present invention, in which the size of the holes at a lesser angle is increased with the aim of increasing the power of the corresponding flames and giving them a greater ability to heat the pot, comparable, for instance, to that of the flames having a greater angle.

In making that improvement, however, the applicant noticed that, with this increase in the size of the holes, the risk of backfire phenomena also increases. The applicant has found that, in order to reduce this risk, the number of holes simply needs to be increased while reducing the size thereof, so as to still have the desired gas flow. For example, instead of having two holes of a certain diameter aligned vertically, three holes of a lesser diameter, still aligned vertically, can be made.

The applicant has furthermore noticed that greater oxygenation of the flames can be achieved by making the vertically aligned holes—i.e. those which contribute to the formation of the same flame—slightly divergent with respect to each other. Clearly, the difference in angle between the vertically aligned holes will be much smaller than the difference in angle between these holes and the next or preceding set of holes in the lateral direction along the side wall of the ring.

Consequently, the present invention refers to a gas cooktop burner comprising a main body equipped with a first plurality of holes capable of producing first flames having a first angle with respect to the horizontal plane of reference, and a second plurality of holes capable of producing second flames having a second angle with respect to said horizontal plane which is less than the first angle, said first and second pluralities of holes consisting of corresponding groups of holes, each of which being associated with the same flame and each of which consisting of at least one hole, wherein the total cross-sectional area of each group of holes in the second plurality of holes is greater than the total cross-sectional area of each group of holes in the first plurality of holes, such that the second flames have a greater power than the first flames.

Preferably, the main body has a substantially cylindrical or frustoconical side wall through which said first and second pluralities of holes pass. In addition, the main body preferably has a substantially horizontal or slightly conical upper wall.

The aforementioned first angle of the first plurality of holes is preferably between 30° and 40°. The aforementioned second angle of the second plurality of holes is preferably between 10° and 20°.

Preferably, each aforementioned group of holes includes a number of holes of between one and five. More preferably, this number is equal to two or three. In a preferred embodiment, each group of holes in the first plurality of holes includes two holes, and each group of holes in the second plurality of holes includes three holes.

Preferably, each group of holes consists of vertically aligned holes.

The holes in the first plurality of holes have a preferred diameter of between 2.1 mm and 3.1 mm. The holes in the second plurality of holes have a preferred diameter of between 2.8 mm and 3.8 mm.

Each group of holes can advantageously include at least two mutually divergent holes so as to achieve better oxygenation of the flame. In particular, according to a preferred embodiment, each group of holes in the first plurality of holes includes two mutually divergent holes, and each group of holes in the second plurality of holes includes three mutually divergent holes.

Adjacent divergent holes preferably form an angle with respect to each other of between 3° and 7°.

According to one possible embodiment, each group of holes may include one or more holes having a cross section which is upwardly elongated.

The present invention will now be described in reference to the enclosed figures, which show preferred but non-limiting embodiments of the invention. In particular:

Figure 1:
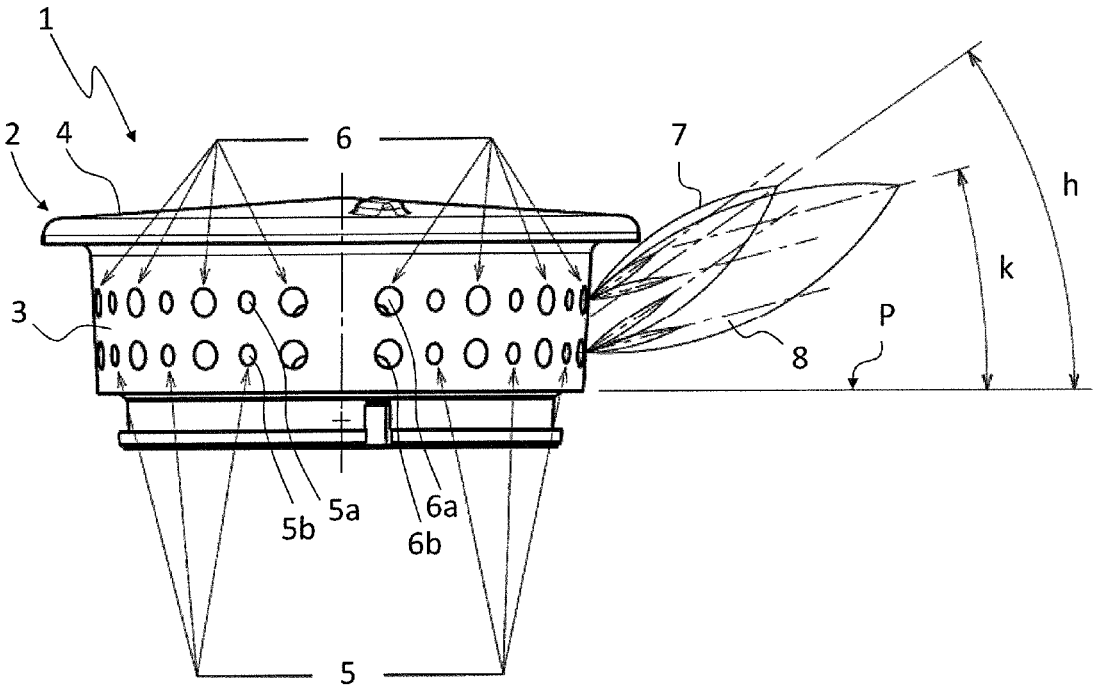
FIG. 1 shows a side view of a first embodiment of a burner according to the present invention.

In reference to FIG. 1, burner 1 is shown having main body 2 substantially in the shape of a cup, comprising substantially cylindrical or frustoconical side wall 3 and substantially horizontal but slightly conical upper wall 4.

The main body 2 is provided with holes 5 and 6 which pass through side wall 3 and form flames of differing angles with respect to horizontal plane P, which will be used from time to time as a reference for the angles of the holes and flames.

In particular, main body 2 is provided with a first plurality of holes 5 at a first angle h and capable of forming flames at this angle, and a second plurality of holes 6 at a second angle k, which is less than the first angle, and capable of forming flames at this angle. Preferably, the first angle h is between 30° and 40°, whereas the second angle k is between 10° and 20°.

Both the first plurality of holes 5 and the second plurality of holes 6 are provided with corresponding groups of holes, each of which can produce a corresponding flame through the combination of several flamelets.

Each group of holes is made of holes having substantially the same angle, although it is possible, as described hereinbelow, for the holes in a given group to diverge slightly with respect to each other.

Along side wall 3 there will consequently be alternating groups of holes (preferably with the corresponding axes aligned in a vertical plane) substantially having the first angle h, and groups of holes (preferably with corresponding axes aligned in a vertical plane) substantially having the second angle k. This alternation may be interrupted at specific points on side wall 3 at which, for example, groups of holes may be missing.

In the embodiment of FIG. 1, both the groups of holes in the first plurality 5 and the groups of holes in the second plurality 6 consist of two vertically aligned holes.

In particular, the groups of holes of the first plurality 5 include one upper hole 5*a* and one lower hole 5*b*, which produce corresponding flamelets that combine to create a single flame at angle h (the flame with a larger angle), whereas the groups of holes in the second plurality 6 include one upper hole 6*a* and one lower hole 6*b*, which produce corresponding flamelets that combine to create a single flame at angle k (a flame with a smaller angle).

Preferably, in the embodiment of FIG. 1, holes 5 of the first plurality have a diameter of between 2.1 mm and 3.1 mm, and holes 6 of the second plurality have a diameter of between 2.8 mm and 3.8 mm.

According to the present invention, the total cross-sectional area of each group of holes 6 in the second plurality is greater than the total cross-sectional area of each group of holes 5 in the first plurality. Consequently, the total area obtained by the sum of the cross-sectional areas of hole 6*a* and hole 6*b* is greater than the total area obtained by the sum of the cross-sectional areas of hole 5*a* and hole 5*b*.

In general, the rule of the present invention is that the overall area of the holes which combine to produce a flame having a smaller angle must be greater than the overall area of the holes which combine to produce a flame having a greater angle.

In this way, there will be a greater gas flow through the holes producing the flame with a smaller angle, and therefore the flame with a smaller angle will have a greater power than the flame having a larger angle. The flame with a smaller angle can therefore compensate for the smaller ability to heat up the object being heated (a pot or other item), due to the smaller angle thereof, with the greater power thereof.

Figure 2:
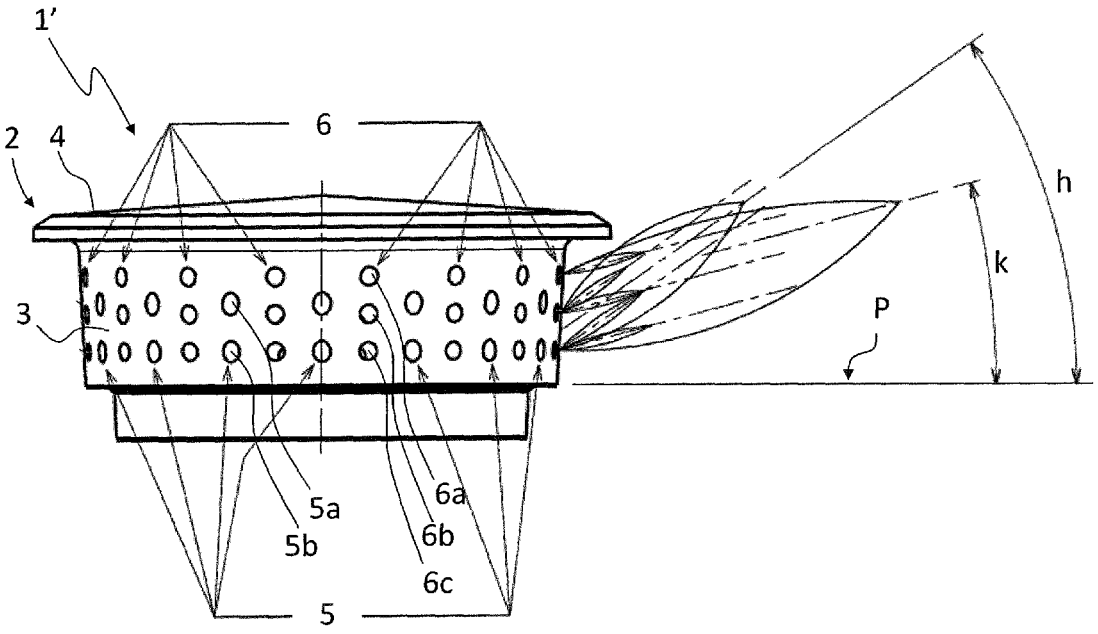
FIG. 2 shows a side view of a second embodiment of a burner according to the present invention.

FIG. 2 shows a second embodiment of the burner according to the present invention, indicated here as 1'. The remaining numbers are the same as in the previous embodiment, with only the quantities or dimensions of some parts differing.

Burner 1' in FIG. 2 differs from burner 1 in FIG. 1 in the number of holes 6 which combine to produce a single flame having a smaller angle, said number going from two to three. Here, each group of holes of the second plurality of holes 6 includes three holes, which are still vertically aligned with each other.

In addition, these three holes are smaller than the corresponding two holes in the embodiment of FIG. 1.

This difference makes it possible to reduce the risk of backfire which could occur in the embodiment of FIG. 1 due to the increased size of holes 6.

In detail, as shown in FIG. 2, each group of holes 6 which combine to produce a single flame includes a first hole 6*a*, a second hole 6*b* under the first, and a third hole 6*c* under the second.

However, groups of holes 5 still consist of two holes as in the first embodiment.

Figure 3:
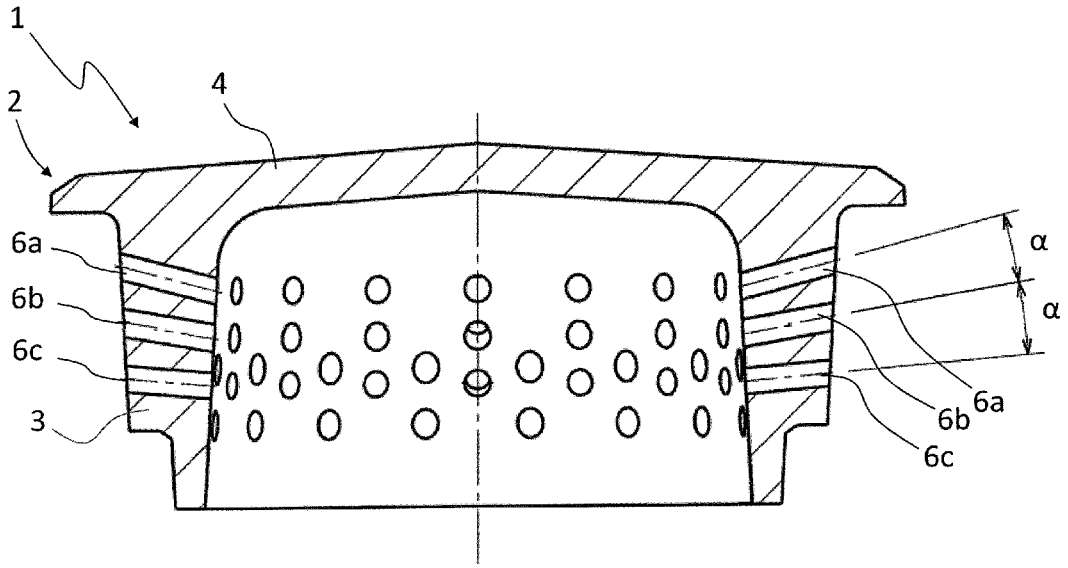
FIG. 3 shows a vertical cross section of the main body of the burner in FIG. 2 along a plane passing through the holes having a smaller angle.
Figure 4:
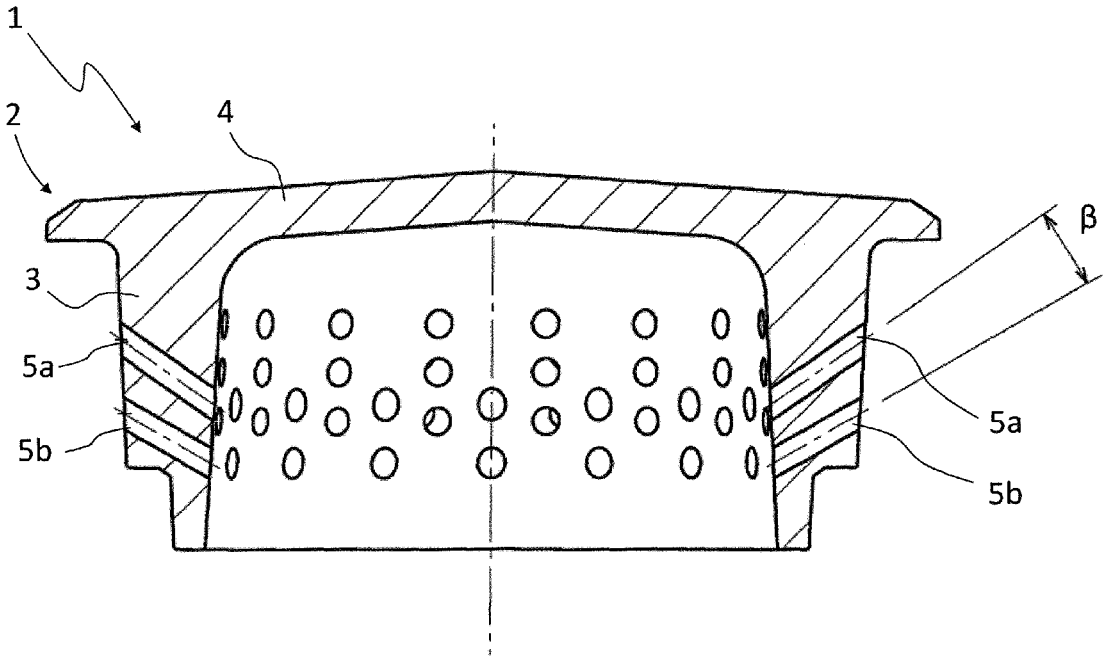
FIG. 4 shows a vertical cross section of the main body of the burner in FIG. 2 along a plane passing through the holes having a larger angle.

In addition, as shown in FIGS. 3 and 4, both holes 5 belonging to a single group and holes 6 belonging to a single group can be made slightly divergent with respect to each other in order to improve flame oxygenation.

As a result, as shown in FIG. 3, there can an angle $\alpha$ greater than 0° between hole 6*a* and hole 6*b*, and there can be the same angle between hole 6*b* and hole 6*c*. Optionally, the angle between holes 6*b* and 6*c* may differ from the angle between holes 6*a* and 6*b*.

Similarly, as shown in FIG. 4, there may be an angle $\beta$ between hole 5*a* and hole 5*b*, which may optionally be equal to angle $\alpha$.

Preferably, both angle $\alpha$ and angle $\beta$ are between 3° and 7°. For example, both of these angles may be equal to 5°.

It is furthermore clear that numerous modifications or variants may be made to the embodiments described above without exceeding the scope of protection of the present invention.

For example, the number of holes in each group—that is, the number of holes which form a single flame—may also be equal to one. This is the case of the burner structure shown in FIG. 6 of the aforementioned patent application FR2841326, in which, however, the size of the holes producing the flames at a smaller angle is greater than the size of the holes producing the flames at a greater angle.

In practice, in a burner according to the present invention, each group of holes preferably includes a number of holes of between one and five, and more preferably between two and three. In the more preferred embodiment described above, each group of holes in the first plurality includes two holes, and each group of holes in the second plurality includes three holes.

According to another variant not shown, instead of having within each group of holes several vertically aligned holes with a circular cross section, it is possible to have a smaller number of holes with an upwardly elongated cross section, such as an ellipse. In practice, this is as if two or more vertically aligned holes were joined together. Consequently, instead of the two vertically aligned holes 6*a* and 6*b* having a circular cross section in FIG. 1, there can be a single hole with an elliptical cross section, instead of the three vertically aligned holes 6*a*, 6*b*, and 6*c* in FIG. 2, there can be one or two holes with an elliptical cross section, or one with a circular cross section and one with an elliptical cross section, and instead of the two holes 5*a* and 5*b* in FIGS. 1 and 2, there can be a single hole with an elliptical cross section.

In addition, it is clear that in the embodiments illustrated in FIGS. 1 and 2 the holes could have a cross section differing slightly from a circular cross section, and therefore the numerical diameter values indicated earlier must be considered average diameter values.

Concerning the divergence of the holes belonging to a single group (that is, the holes combining to form the same flame), it is obvious that, in the case of groups consisting of more than two holes, not all the holes necessarily have to be mutually divergent, and it could be sufficient to make at least two holes mutually divergent in order to achieve the aforementioned effect of greater flame oxygenation. For instance, in the example of FIG. 3, holes 6*a* and 6*b* could be mutually divergent, and holes 6*b* and 6*c* could be parallel to each other, or vice versa.

The invention claimed is:

1. A burner for a gas cooktop comprising:

a main body having:

a first group of holes capable of producing a first flame at a first angle (h) with respect to a horizontal reference plane (P);

a second group of holes capable of producing a second flame at a second angle (k) with respect to said horizontal plane (P), with the second angle (k) being smaller than the first angle (h); and wherein:

the total cross-sectional area of the second group of holes is greater than the total cross-sectional area of the first group of holes, such that the second flame has a greater power than the first flame, and the first group of holes and the second group of holes each comprises a respective plurality of holes that are vertically aligned with respect to the horizontal reference plane (P).

2. The burner according to claim 1, characterized in that the main body has a substantially cylindrical or frustoconical side wall through which said first and second pluralities of holes pass.

3. The burner according to claim 1, characterized in that the first angle (h) is between 30° and 40°.

4. The burner according to claim 1, characterized in that the second angle (k) is between 10° and 20°.

5. The burner according to claim 1, characterized in that the first group and the second group of holes each comprises a number of holes up to five.

6. The burner according to claim 5, characterized in that each group of holes includes a number of holes equal to two or three.

7. The burner according to claim 6, characterized in that the first group of holes includes two holes, and the second group of holes includes three holes.

8. The burner according to claim 7, characterized in that the first group of holes includes two mutually divergent holes, and the second group of holes includes three mutually divergent holes.

9. The burner according to claim 1, characterized in that the holes of the second group have a diameter of between 2.8 mm and 3.8 mm.

10. The burner according to claim 1, characterized in that the holes of the first group have a diameter of between 2.1 mm and 3.1 mm.

11. The burner according to claim 1, characterized in that the first group and the second group of holes each comprises at least two mutually divergent holes.

12. The burner according to claim 11, characterized in that adjacent divergent holes form an angle of between 3° and 7° with each other.

13. The burner according to claim 1, characterized in that the first group and the second group of holes each comprises one or more holes having an upwardly elongated cross section.

14. The burner according to claim 1, characterized in that the main body has a substantially horizontal or slightly conical upper wall.

15. The burner according to claim 1, wherein the first group of holes is adjacent to the second group of holes.

16. The burner according to claim 1, said main body having a side wall, wherein pluralities of said respective first and second groups of holes are provided through said side wall, distributed about a circumference thereof.

17. The burner according to claim 16, wherein said pluralities of first and second groups of holes are distributed alternately about said circumference.

* * * * *